US006135612A

United States Patent [19]

Clore

[11] Patent Number: 6,135,612

[45] Date of Patent: Oct. 24, 2000

[54] DISPLAY UNIT

[76] Inventor: William B. Clore, 620 Black Walnut Ct., Hendersonville, N.C. 28792

[21] Appl. No.: 09/280,389

[22] Filed: Mar. 29, 1999

[51] Int. Cl.[7] ..... F21V 33/00

[52] U.S. Cl. ..... 362/184; 362/244; 362/247; 362/800

[58] Field of Search ..... 362/35, 184, 185, 362/186, 235, 240, 244, 245, 246, 247, 336, 341, 350, 355, 356, 800, 806, 809, 811, 347

[56] References Cited

U.S. PATENT DOCUMENTS 4,978,948 12/1990 Samen ..... 362/806
5,642,933 7/1997 Hitora ..... 362/245
5,769,532 6/1998 Sasaki ..... 362/237
5,806,965 9/1998 Deese ..... 362/800
5,929,788 7/1999 Vukasic ..... 362/800

*Primary Examiner*—Y. Quach
*Attorney, Agent, or Firm*—Joseph T. Guy

[57] ABSTRACT

The present invention is directed to an improved signal light. The signal lamp comprising a base and at least one hollow cylindrical light transmitting column attached to the base. A light source in contained in the column wherein the light source comprises: a mounting plate; a globe reflector element attached to the mounting plate; and at least one LED directed toward the reflector element.

19 Claims, 4 Drawing Sheets

DISPLAY UNIT

BACKGROUND OF THE INVENTION

The present invention is related to a signal display lamp which is suitable for signaling a warning or alerting to a particular condition.

The number of display lamps for signaling a warning or condition are legion in number. The use of LED's as the illuminating source has greatly increased the number of such lights since LED's require lower energy and generate less heat than incandescent bulbs and LED's do not expire as readily. While LED's have major advantages over conventional incandescent lights they require a different light design since LED's emit a light cone as opposed to the radiant light typically observed with incandescent lights.

Various designs have been presented to convert the light cone of an LED into a light globe as required in many applications.

One such example is provided in U.S. Pat. No. 5,769,532 wherein a series of reflectors are used to diffuse the light. This particular design is an improvement yet the light is still difficult to observe at steep angles from above and below the lamp.

A simple design which allows for a wide viewing area has been lacking in the art. The present invention provides a display lamp with an improved field of view.

SUMMARY OF THE INVENTION

It is an object of the present invention to provide a display light with a superior field of view.

It is another object to provide a display light which takes advantage of the superior qualities available with LED's while still providing a superior field of view.

These and other advantages are provided in a signal lamp comprising a base and at least one hollow cylindrical light transmitting column attached to the base. A light source is contained in the column wherein the light source comprises: a mounting plate; a globe reflector element attached to the mounting plate; and at least one LED directed toward the reflector element.

A preferred embodiment is provided in a signal lamp comprising a base and at least one hollow cylindrical transmitting column attached to said base. A light socket is contained within the column. Also within the column is a light source comprising: a mounting plate; a globe reflector attached to the mounting plate; and at least one LED attached to the mounting plate and directed towards the globe reflector. A light socket base is electrically connected to said LED and the light socket base is receivable within the light socket.

A particularly preferred embodiment is provided in a light source comprising a mounting plate and a globe reflector attached to the light mounting plate. A first LED is attached to the mounting plate and directed towards the globe reflector. The light source further comprises a light socket base electrically connected to the first LED.

DETAILED DESCRIPTION OF THE INVENTION

Throughout the following description similar elements are numbered accordingly.

Figure 1:
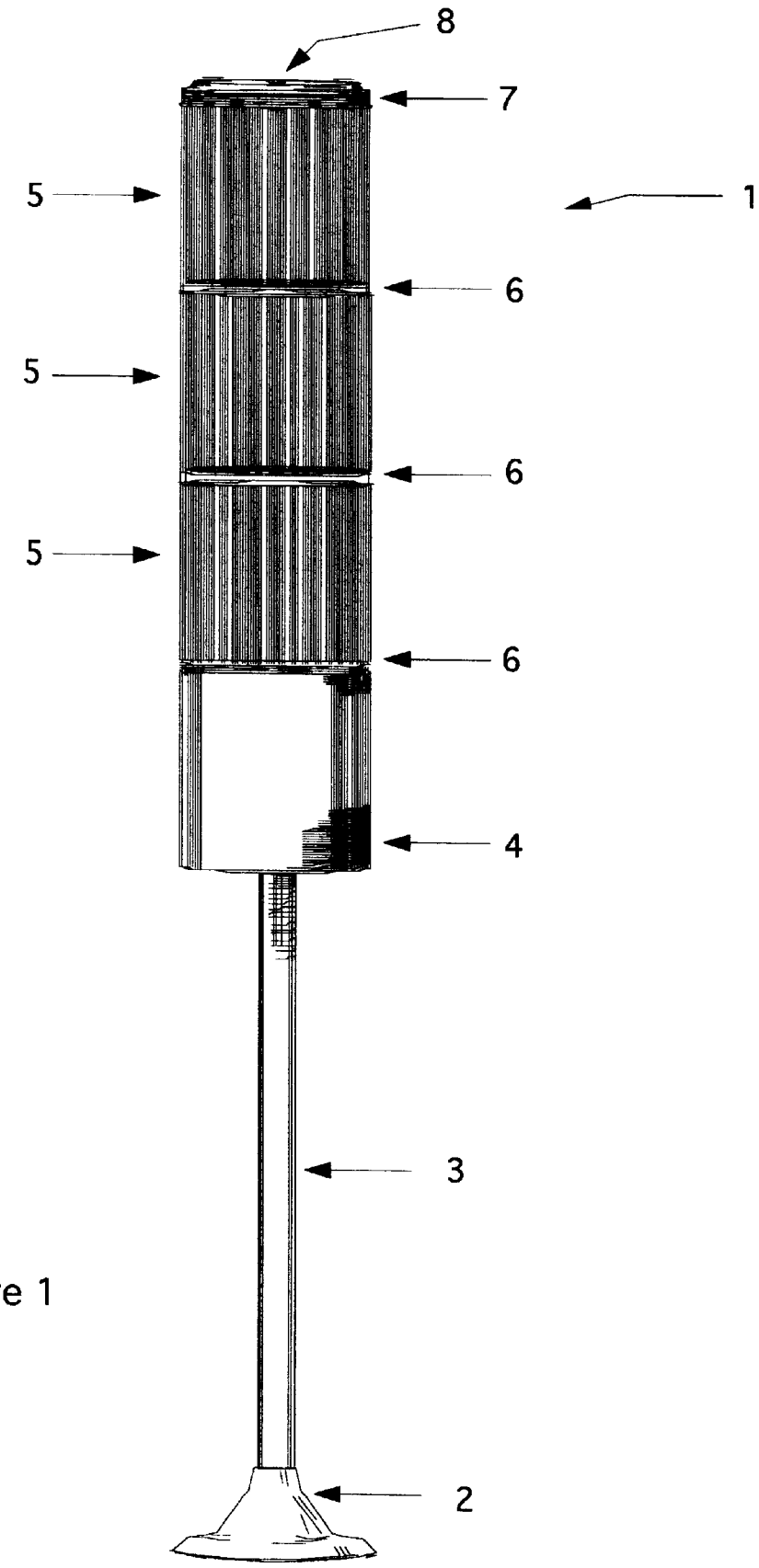
FIG. 1 is a perspective view of the exterior of a fully assembled display lamp.

FIG. 1 illustrates a signal light generally represented at 1. The signal light comprises a mounting bracket, 2, which is standard in the art for attaching a signal light to a piece of equipment or the like. An optional mounting pole, 3, may separate the mounting bracket from a base, 4, if desired. The electrical power source, not shown, is preferably enclosed in the mounting pole. The base, 4, is optional but preferred as a convenient location for wiring connections, control boards, if present, and as an attachment means for the elements necessary to form operating portions of the signal light. The design, appearance and function of the mounting bracket, mounting pole and base may be broadly interpreted as well known in the art.

The illuminating portion of the signal light comprises at least one cylindrical transmitting column, 5, which diffuses light. Between cylindrical transmitting columns are optional but preferred covers, 6, to isolate light to a single column. A cap, 7, attached with a mounting means, 8, covers the uppermost cylindrical transmitting column and eliminates, or reduces, light leak from the uppermost column.

Figure 2:
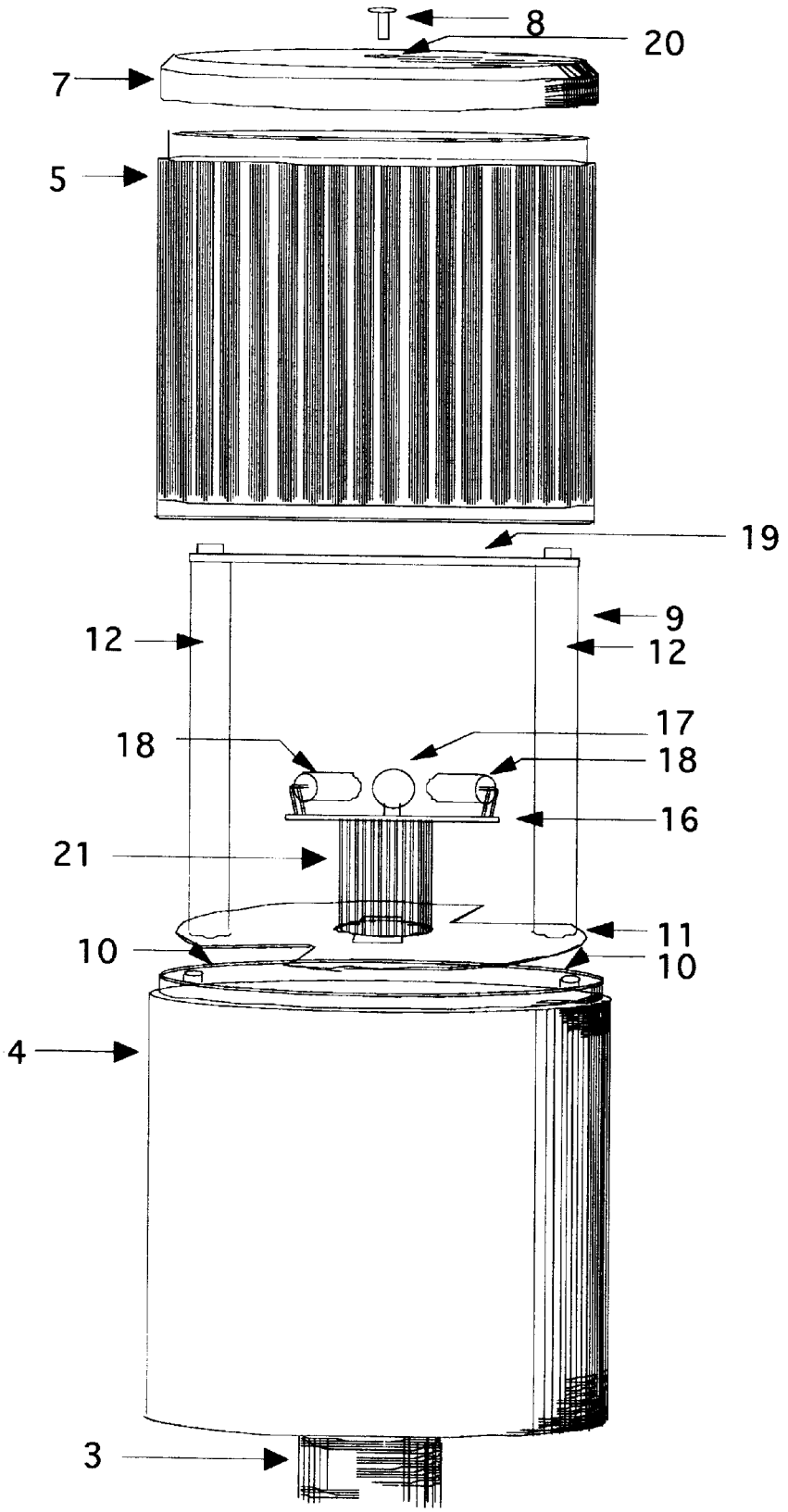
FIG. 2 is an exploded view of an embodiment of the present invention.

FIG. 2 is an exploded view of an embodiment of the present invention. In FIG. 2, an optional mounting pole, 3, and base, 4, are as described previously. A mounting bracket assembly, 9, attaches to the base, 4, by engaging a pair of tubes, 12, over a pair of lugs, 10, which are integral to the base. The tube can attach to the lug by a variety of methods as known in the art including snap-fit, or a threaded rod interior to the tube. The mounting bracket assembly, 9, comprises a bracket plate, 11, and a top plate 19, both rigidly attached to the tubes. A support, 21, attached to the bracket plate, 11, provides support for the light source which will be described in further detail below. The mounting bracket assembly, and attached light source are received within the cylindrical transmitting column, 5, which is in turn secured in place by a cap, 7. The cap, 7, is secured to the top plate, 19, by an attachment means, 8, such as a screw or rivet, which is inserted through a hole, 20, in the cap.

The light source comprises at least one LED, 18, attached to a mounting plate, 16. Each LED is directed toward a globe reflector, 17. Light is emitted from the LED which reflects off of the globe reflector and is emitted through the cylindrical transmitting column.

Figure 3:
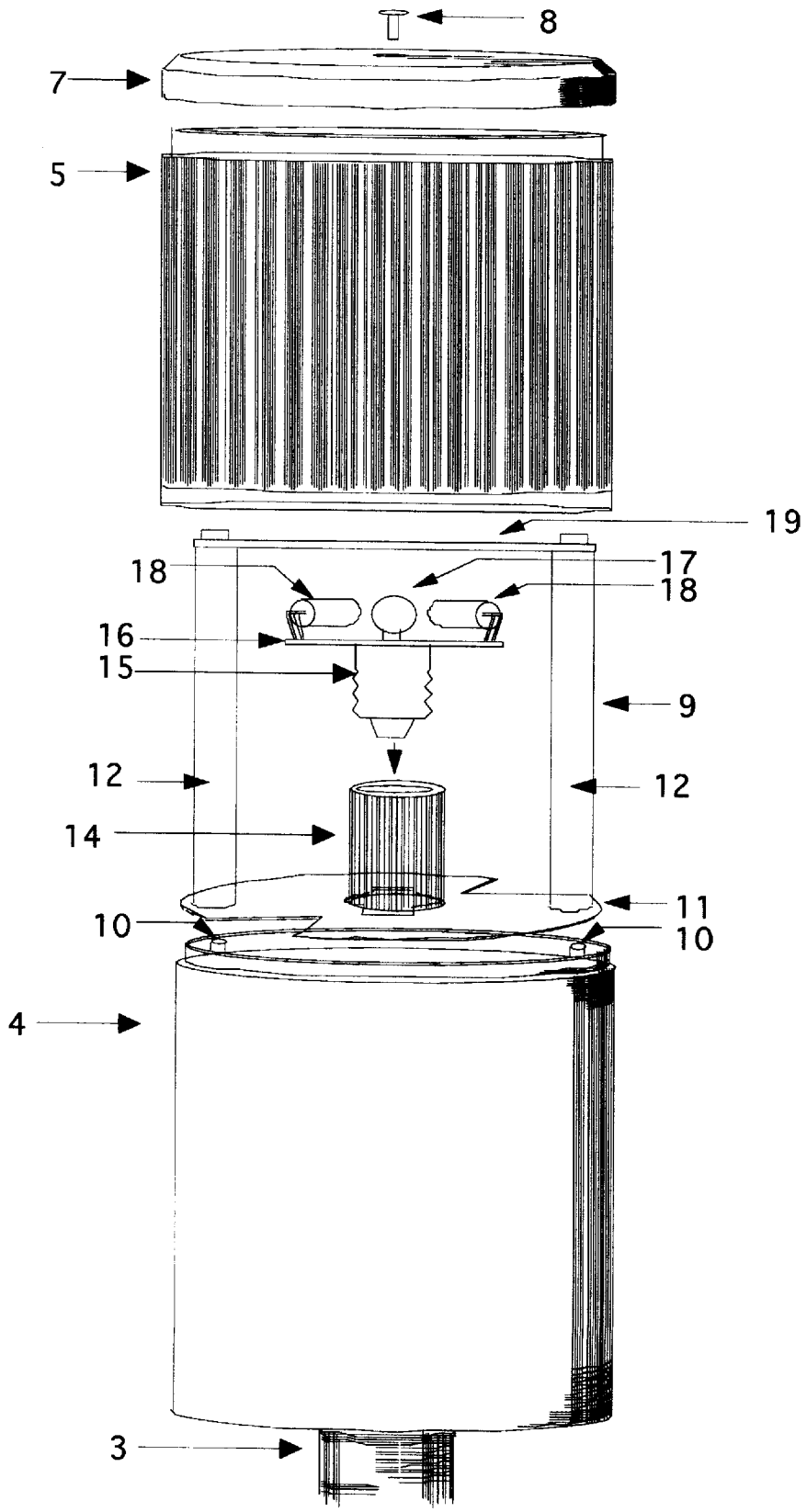
FIG. 3 is an exploded view of a preferred embodiment of the present invention.

FIG. 3 comprises a preferred embodiment of the present invention. In FIG. 3 the bracket plate, 11, comprises a light socket, 14, and the light source comprises a light socket base, 15. The light socket and light socket base preferably comprise complementary threads, as common in an AC light bulb, or complementary protrusions and slots, as common in a DC automobile, such that the light source can be easily removed and replaced in the event of a LED burnout or the like. This embodiment also allows for the replacement of the light source with a light source of more, or fewer, LED's.

Figure 4:
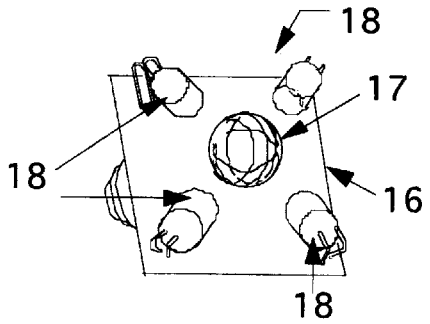
FIGS. 4, 5 and 6 illustrate different embodiments of the LED configuration in the present invention.
Figure 5:
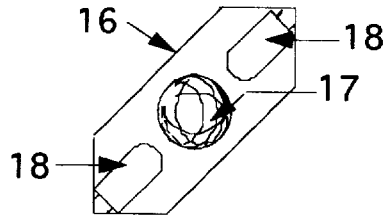
Figure 6:
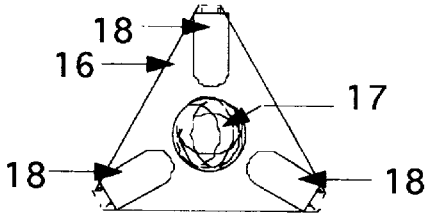

FIGS. 4, 5 and 6 illustrate various configurations of the light source. FIG. 4 illustrates the preferred orientation when four LED's are used. The four LED's are arranged in a square with the globe reflector in the center of the square. The four LED's and the globe reflector form a plane. The mounting plate is illustrated as a square for convenience, however, any shape is considered within the teachings of the present invention. FIG. 5 illustrates a linear arrangement which is the preferred orientation with two LED's. In this arrangement the two LED's and the globe reflector form a line. In FIG. 6 three LED's are arranged in an equilateral triangle with the globe reflector contained in the center. The number of LED's is not particularly limiting. It is most preferable for the LED's to be symmetrically arranged.

Figure 7:
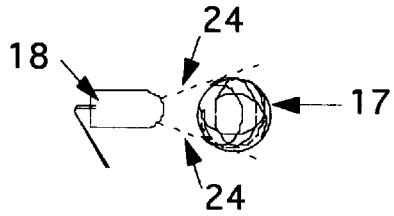
FIG. 7 is an explanatory diagram illustrating optimal LED reflector separation.

The optimal spacing between the LED and the reflector is determined by the light cone of the LED. The optimal spacing is illustrated in FIG. 7. As shown in FIG. 7 the LED, 18, emits directed light in a cone the boundaries of which are represented by ray lines, 24. The optimal distance between the LED and the reflector is that which allows the ray lines to be tangential to the reflector as shown in FIG. 7. If the distance between the reflector and LED is greater than the optimal distance some of the light emitted from the LED bypasses the reflector resulting in a shadow on the opposite side of the light source. If the distance is too short then the maximum reflective cone is compromised.

Figure 8:
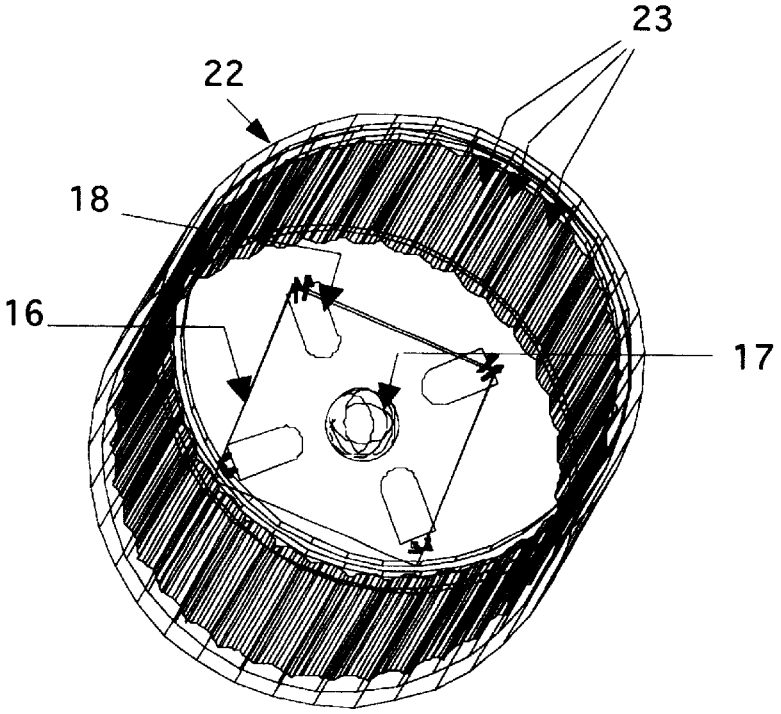
FIG. 8 is a perspective view of a cylindrical parallel convex magnifier as employed in the present invention.

A preferred cylindrical transmitting column is illustrated in FIG. 8. In FIG. 8 a cylindrical parallel convex magnifier, 22, is illustrated. The cylindrical parallel convex magnifier, 22, comprises a multiplicity of linear convex lens, 23, arranged in parallel on the surface of a cylinder. The cylindrical parallel convex magnifier is extremely efficient at reflecting light and diffuses the light source sufficiently that the entire cylinder appears to be illuminated.

The globe reflector is most preferably a polished sphere or an ellipse. If an ellipse is used the ratio of the major axis to the minor axis is preferably no more than 2 to 1. Most preferably the globe does not contain facets. Facets can be employed with small facets being preferred. As the size of the facet increases the light becomes more anisotropic which is not desirable. The size of the globe reflector is chosen to optimize the distance from the LED and the cone required for adequate lighting.

The present invention has been illustrated and described and the preferred embodiments thereof have been provided. It would be apparent that a skilled artisan could employ other embodiments without departing from the scope of the invention as described herein and illustrated with the examples.

What is claimed is:

1. A signal lamp comprising:

a base;

at least one hollow cylindrical light transmitting column attached to said base;

a light source in said column;

said light source comprises:

a mounting plate;

a globe reflector element attached to said mounting plate; and at least one LED directed toward said globe reflector element.

2. The signal lamp of claim 1 comprising a multiplicity of LEDs directed toward said globe reflector element.

3. The signal lamp of claim 2 wherein said LEDs are arranged in a plane containing said globe reflector element.

4. The signal lamp of claim 3 wherein said plane is perpendicular to an axis of said cylindrical light transmitting column.

5. The signal lamp of claim 1 comprising a multiplicity of cylindrical light transmitting columns.

6. The signal lamp of claim 1 wherein said cylindrical transmitting column is a cylindrical parallel convex magnifier.

7. The signal lamp of claim 1 wherein said cylindrical transmitting column comprises a multiplicity of parallel linear convex lens.

8. A signal lamp comprising:

a base;

at least one hollow cylindrical light transmitting column attached to said base;

a light socket within said column; and a light source comprising:

a mounting plate;

a globe reflector attached to said mounting plate;

at least one LED attached to said mounting plate directed towards said globe reflector;

a light socket base electrically connected to said LED;

wherein said light socket base is receivable within said light socket.

9. The signal lamp of claim 8 comprising a multiplicity of LEDs wherein said LEDs are directed towards said globe reflector.

10. The signal lamp of claim 9 wherein said multiplicity of LEDs and said globe reflector are contained in a plane.

11. The signal lamp of claim 8 wherein said light socket and said light socket base are threaded.

12. The signal lamp of claim 8 wherein said cylindrical transmitting column is a cylindrical parallel convex magnifier.

13. The signal lamp of claim 8 wherein said cylindrical transmitting column comprises a multiplicity of parallel linear convex lens.

14. A light source comprising:

a mounting plate;

a globe reflector attached to said mounting plate;

a first LED attached to said mounting plate directed towards said globe reflector;

a light socket base electrically connected to said first LED.

15. The light source of claim 14 comprising a second LED attached to said mounting plate directed towards said globe reflector.

16. The light source of claim 15 comprising a third LED attached to said mounting plate directed towards said globe reflector.

17. The light source of claim 16 comprising a fourth LED attached to said mounting plate directed towards said globe reflector.

18. The light source of claim 17 wherein said first LED, said second LED, said third LED and said fourth LED form a square with said globe reflector located in said square.

19. The light source of claim 14 wherein said light socket base is threaded.

* * * * *